US010225664B2

(12) United States Patent
Shan et al.

(10) Patent No.: US 10,225,664 B2
(45) Date of Patent: Mar. 5, 2019

(54) ELECTRICAL-ACOUSTIC TRANSFORMATION DEVICE

(71) Applicant: Goertek, Inc., Weifang, Shandong (CN)

(72) Inventors: Lianwen Shan, Weifang (CN); Xinfeng Yang, Weifang (CN); Hairong Wang, Weifang (CN); Longhao Cui, Weifang (CN)

(73) Assignee: GOERTEK, INC., Weifang, Shandong (CN)

( * ) Notice: Subject to any disclaimer, the term of this patent is extended or adjusted under 35 U.S.C. 154(b) by 0 days.

(21) Appl. No.: 15/552,677

(22) PCT Filed: Dec. 17, 2015

(86) PCT No.: PCT/CN2015/097754
§ 371 (c)(1),
(2) Date: Aug. 22, 2017

(87) PCT Pub. No.: WO2016/184093
PCT Pub. Date: Nov. 24, 2016

(65) Prior Publication Data

US 2018/0041844 A1 Feb. 8, 2018

(30) Foreign Application Priority Data

May 21, 2015 (CN) ..... 2015 1 0263316

(51) Int. Cl.
*H04R 9/06* (2006.01)
*H04R 9/04* (2006.01)
(Continued)

(52) U.S. Cl.
CPC ..... *H04R 23/02* (2013.01); *B06B 1/0292* (2013.01); *B06B 1/045* (2013.01); *B06B 1/0648* (2013.01);
(Continued)

(58) Field of Classification Search
CPC . H04R 23/02; H04R 1/02; H04R 1/22; H04R 1/24; H04R 7/04; H04R 7/10;
(Continued)

(56) References Cited

U.S. PATENT DOCUMENTS

2014/0133690 A1* 5/2014 Yang ..... H04R 9/02 381/400
2015/0010173 A1 1/2015 Bernal Castillo et al.

FOREIGN PATENT DOCUMENTS

CN 201533406 U * 7/2010
CN 102281488 A 12/2011
(Continued)

*Primary Examiner* — Sunita Joshi
(74) *Attorney, Agent, or Firm* — Hultquist, PLLC; Steven J. Hultquist

(57) ABSTRACT

Disclosed is an electrical-acoustic transformation device, including: a vibration system and a magnetic circuit system with a magnetic gap; wherein the vibration system includes: a diaphragm, a voice coil provided below the diaphragm and suspending in the magnetic gap, and a piezoelectric plate provided on one side of the diaphragm; and conductive lines are formed on the diaphragm, the conductive lines include a first conductive line connected to the piezoelectric plate to input an externally input first audio signal to the piezoelectric plate via the first conductive line. The electrical-acoustic transformation device in the present invention has a moving coil sound generating structure and a piezoelectric sound generating structure. The piezoelectric plate compensates the high-frequency response of the vibration system, realizing an electrical-acoustic transformation device with good performance and super wideband.

8 Claims, 3 Drawing Sheets

(51) Int. Cl.

| | |
|---|---|
| ***H04R 7/10*** | (2006.01) |
| ***H04R 7/04*** | (2006.01) |
| ***H04R 17/00*** | (2006.01) |
| ***B06B 1/02*** | (2006.01) |
| ***B06B 1/04*** | (2006.01) |
| ***B06B 1/06*** | (2006.01) |
| ***H04R 1/02*** | (2006.01) |
| ***H04R 1/06*** | (2006.01) |
| ***H04R 1/22*** | (2006.01) |
| ***H04R 1/24*** | (2006.01) |
| ***H04R 23/02*** | (2006.01) |

(52) U.S. Cl.
CPC ..... *H04R 1/02* (2013.01); *H04R 1/22* (2013.01); *H04R 1/24* (2013.01); *H04R 7/04* (2013.01); *H04R 7/10* (2013.01); *H04R 9/04* (2013.01); *H04R 1/06* (2013.01); *H04R 9/06* (2013.01); *H04R 17/00* (2013.01)

(58) Field of Classification Search
CPC ... H04R 9/04; H04R 1/06; H04R 9/06; H04R 17/00; H01L 41/00; H01L 41/0973; B06B 1/0292; B06B 1/045; B06B 1/0648
See application file for complete search history.

(56) References Cited

FOREIGN PATENT DOCUMENTS

| | | | |
|---|---|---|---|
| CN | 202310082 | U | 7/2012 |
| CN | 202799117 | U | 3/2013 |
| CN | 204305300 | U | 4/2015 |
| CN | 104869508 | A | 8/2015 |

* cited by examiner

ELECTRICAL-ACOUSTIC TRANSFORMATION DEVICE

CROSS-REFERENCE TO RELATED APPLICATIONS

This application is a U.S. national phase under the provisions of 35 U.S.C. § 371 of International Patent Application No. PCT/CN2015/097754 filed Dec. 17, 2015, which in turn claims priority of Chinese Patent Application No. 201510263316.4 filed May 21, 2015. The disclosures of such international patent application and Chinese priority patent application are hereby incorporated herein by reference in their respective entireties, for all purposes.

TECHNICAL FIELD

The present invention relates to an electrical-acoustic transformation device.

BACKGROUND

Ordinary moving coil receiver and speaker are referred to as moving coil electrical-acoustic transformation device. No matter if it is applied to a mobile phone or an earphone, rapid drop will occur in the high frequency response curve of the receiver at 6 k-9 kHz and rapid drop will also occur in the high frequency response curve of the speaker after 10 KHz, which is the so-called high frequency cutoff frequency. Due to the limitations of the material and process of the moving coil electrical-acoustic transformation device, it is hard to increase the high frequency cutoff frequency.

With the application of 4G communications, electrical-acoustic transformation devices with super wideband are required. The high frequency cutoff frequency is required to be up to 16 kHz and higher. Thus, the existing moving coil electrical-acoustic transformation device cannot meet these requirements.

SUMMARY

An object of the present invention is to provide a new technical solution of an electrical-acoustic transformation device with super wideband.

The present invention provides an electrical-acoustic transformation device, including: a vibrating system and a magnetic path system with a magnetic gap; wherein the vibrating system includes: a diaphragm, a voice coil provided below the diaphragm and suspending in the magnetic gap, and a piezoelectric plate provided on one side of the diaphragm; conductive lines are formed on the diaphragm, and the conductive lines include a first conductive line connected to the piezoelectric plate to input an externally input first audio signal to the piezoelectric plate via the first conductive line.

Optionally, the piezoelectric plate is provided above or below the diaphragm.

Preferably, the piezoelectric plate is provided above the diaphragm and the first conductive line is formed on an upper surface of the diaphragm.

Preferably, the conductive lines also include a second conductive line connected to the voice coil to access an externally input second audio signal to the voice coil via the second conductive line.

Preferably, the second conductive line is formed on a lower surface of the diaphragm.

Preferably, the piezoelectric plate is provided at the center location of the diaphragm.

Preferably, the diaphragm includes a planar portion located at the center and a surround portion located at an edge of the planar portion and the piezoelectric plate is provided at the location of the planar portion of the diaphragm.

Preferably, the conductive lines are electroplated on the diaphragm or the conductive lines are formed by the etching of a flexible circuit board laminated on the diaphragm.

Preferably, the device further comprises a housing for accommodating and fixing the vibrating system and the magnetic path system, wherein the housing is injection-molded with electrical connection portions through which the conductive lines are connected to external circuits.

Preferably, the electrical connection portion includes any one of or a combination of the following: an elastic sheet, a spring connector and a flexible circuit board.

The inventors of the present invention have found that there is no electrical-acoustic transformation device with super wideband combined with a moving coil sound generating structure in the prior art. Thus, the technical task to be realized by the present invention or the technical problem to be solved is not contemplated or predicted by those skilled in the art, so the present invention is a new technical solution.

The electrical-acoustic transformation device in the present invention has a moving coil sound generating structure and a piezoelectric sound generating structure. The piezoelectric plate compensates the high-frequency response of the vibrating system, realizing an electrical-acoustic transformation device with good performance and super wideband. Preferably or alternatively, in an embodiment of the present invention, a first conductive line is formed on the diaphragm to input an externally input first audio signal into the piezoelectric plate, thus the wiring is delicate and easy to realize. Preferably or alternatively, the piezoelectric plate in an embodiment of the present invention is provided at the center of the diaphragm and can function as diaphragm reinforcement.

The other features and advantages of the present invention will become clear according to the detailed description of exemplary embodiments of the present invention with reference to the accompanying drawings.

BRIEF DESCRIPTION OF THE DRAWINGS

The figures incorporated in the description and forming a part of the description illustrate the embodiments of the present invention and are used to explain the principle of the present invention along therewith.

REFERENCE SIGNS

Figure 1:
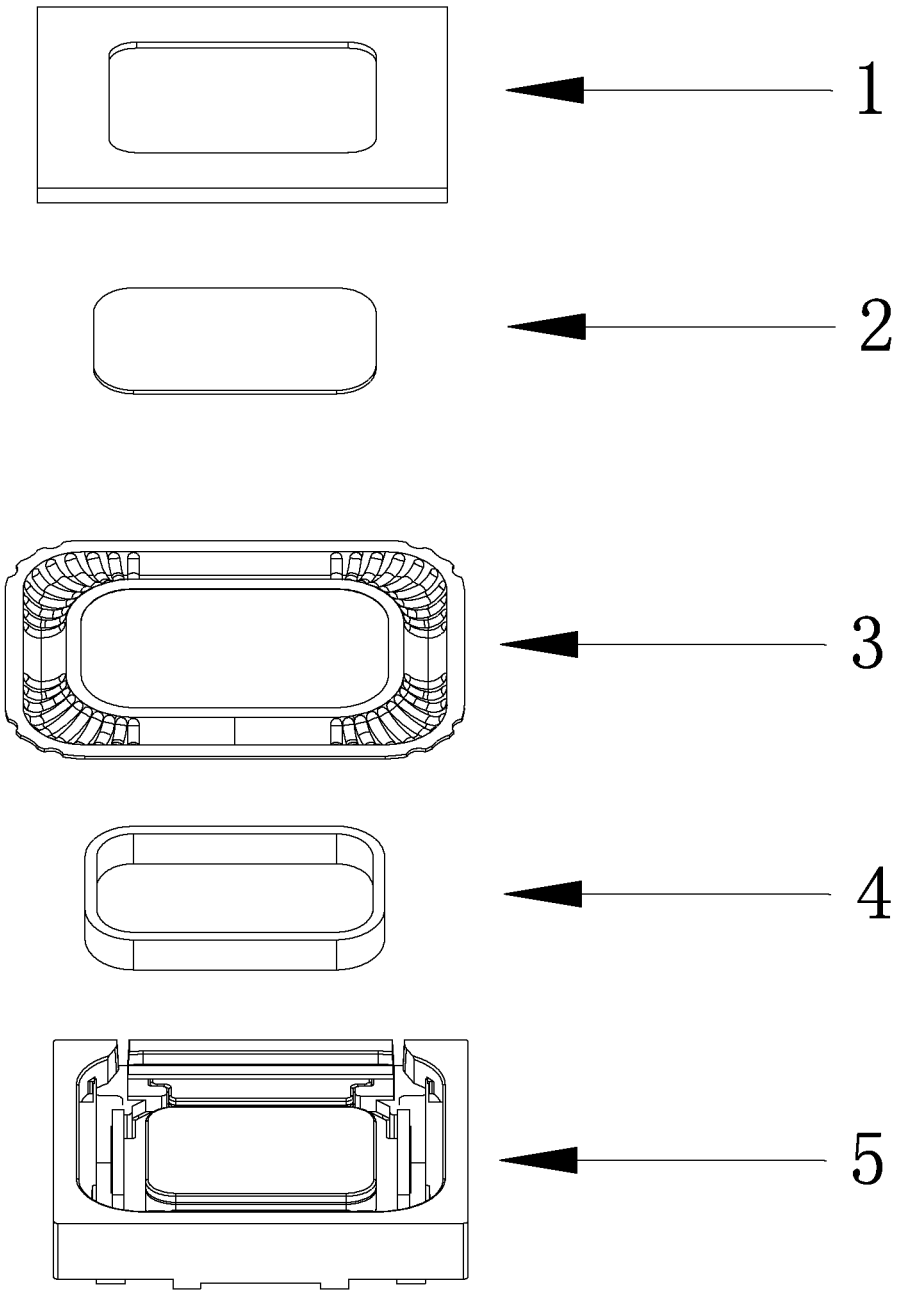
FIG. 1 is a structure view of an electrical-acoustic transformation device according to an embodiment of the present invention.
Figure 2:
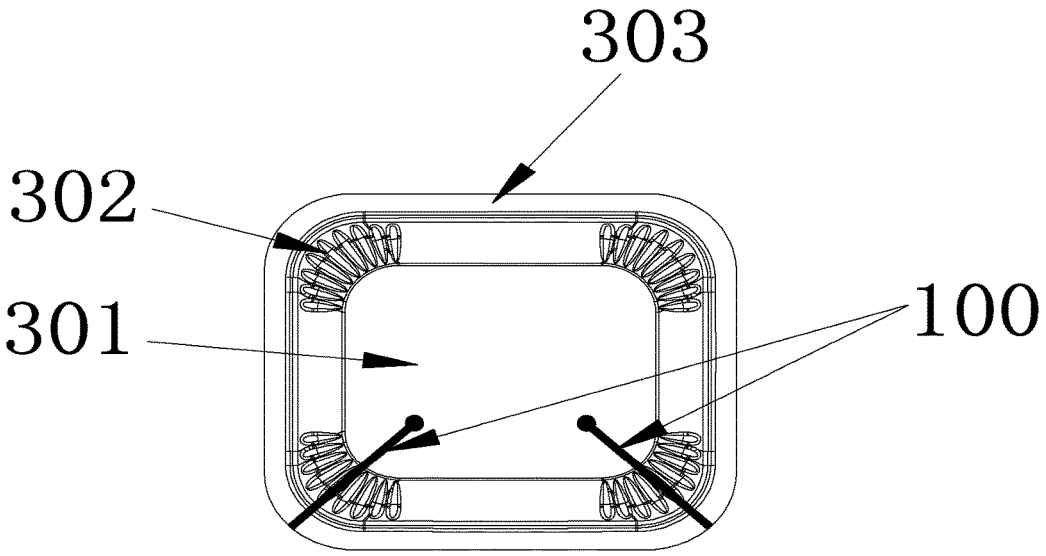
FIG. 2 is a structure view of a diaphragm provided with a first conductive line according to the present invention.

1 front cover, 2 piezoelectric plate, 3 diaphragm, 5 frame and magnetic path system, 301 planar portion, 302 surround portion, 303 fixation portion, 11 first electrical connection portion, 12 second electrical connection portion, 100 first conductive line.

DETAILED DESCRIPTION

Various exemplary embodiments of the present invention will be described in detail with reference to the accompanying drawings. It should be noted that unless stated specifically otherwise, the relative arrangement of the components and steps illustrated in these embodiments, the numeral expressions and the values do not limit the scope of the present invention.

The description of at least one exemplary embodiment of the present invention is actually merely illustrative rather than limiting the present invention and the application or use thereof.

Technologies, methods and devices known to those skilled in the art may not be described in detail, but when appropriate, the technologies, methods and devices shall be regarded as a part of the description.

Any particular value in all examples illustrated and described here shall be construed as merely illustrative rather than limiting. Thus, other examples of the exemplary embodiments may have different values.

It should be noted that similar signs and letters represent similar items in the following figures, and thus, once a certain item is defined in a figure, there is no need to further describe the same in the following figures.

An embodiment of the present invention provides an electrical-acoustic transformation device, where the device includes: a vibration system, a magnetic path system and a housing for accommodating and fixing the vibration system and the magnetic circuit system. The magnetic circuit system includes a washer, a magnet, a frame and so on fixed successively from top to bottom. The magnet may include a center magnet and an edge magnet. Accordingly, the washer may include a center washer and an edge washer. The gap between the center magnet and the edge magnet is the magnetic gap. Of course, the structure of the magnetic circuit system and the provision of the magnetic gap may also be realized otherwise. Those skilled in the art may design the same according to the prior art and the requirements of the application environment. The vibration system includes: a diaphragm, a voice coil provided below the diaphragm and suspending in the magnetic gap, and a piezoelectric plate provided on one side of the diaphragm.

A first conductive line and a second conductive line are formed on the diaphragm. A first audio signal is accessed to the piezoelectric plate via the first conductive line. The piezoelectric plate drives the diaphragm to vibrate and sound. A second audio signal is accessed to the voice coil via the second conductive line. The voice coil drives the diaphragm to vibrate and sound under the action of a magnetic field. The sources of the two audio signals are the same but the power of the first audio signal will be bigger after passing through a power amplification circuit.

By means of the above structure, the combination of a moving voice coil sound generating device and a piezoelectric sound generating device is realized. The high frequency cutoff frequency of the piezoelectric plate may be up to 16 kHz and higher, thus realizing an electrical-acoustic transformation device with good performance and super wideband.

In addition, the piezoelectric plate may be placed at the center location of the diaphragm such that the piezoelectric plate can function as a diaphragm reinforcement portion or DOME. The piezoelectric plate may be provided above or below the diaphragm.

An embodiment of the electrical-acoustic transformation device in the present invention is shown in FIGS. 1 to 4, including the followings successively from top to bottom: a front cover 1, a piezoelectric plate 2, a diaphragm 3, a voice coil 4, and a frame and magnetic circuit system 5.

The magnetic circuit system has a magnetic gap. The front cover 1 and the frame form a housing for accommodating and fixing the vibration system and the magnetic circuit system. The magnetic circuit system and the frame are integrally shown in FIG. 1 schematically.

The piezoelectric plate 2, the diaphragm 3, and the voice coil 4 form the vibration system. It can be seen from FIG. 2 that the diaphragm 3 includes a planar portion 301 located at the center, a surround portion 302 located at the edge of the planar portion and a fixation portion 303 located at the outermost and fixed to the housing. The piezoelectric plate 2 is provided at the planar portion 301 of the diaphragm 3 and combined with the diaphragm 3. The piezoelectric plate 2 so provided can function as a diaphragm reinforcement portion or DOME. FIG. 1 is an exploded view. After being assembled, the voice coil 4 will be suspended in the magnetic gap of the magnetic circuit system.

A first conductive line 100 is formed on an upper surface of the diaphragm 3 for accessing an externally input first audio signal into the piezoelectric plate 2. A second conductive line (not shown) is formed on a lower surface of the diaphragm 3 for accessing an externally input second audio signal into the voice coil 4. The conductive lines may be electroplated on the diaphragm or may be formed by the etching of a flexible circuit board (FPC) laminated on the diaphragm. Furthermore, the diaphragm includes a high polymer material layer. The conductive lines may be electroplated on the high polymer material layer or may be formed by the etching of a flexible circuit board (FPC) laminated on the high polymer material layer. In order to make the process simpler, the diaphragm may be formed by the lamination of a diaphragm material with already laid conductive lines.

Figure 3:
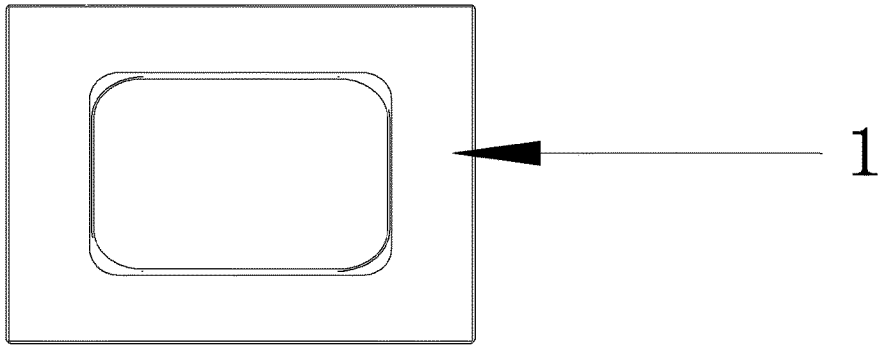
FIG. 3 is a front view of an electrical-acoustic transformation device according to an embodiment of the present invention.
Figure 4:
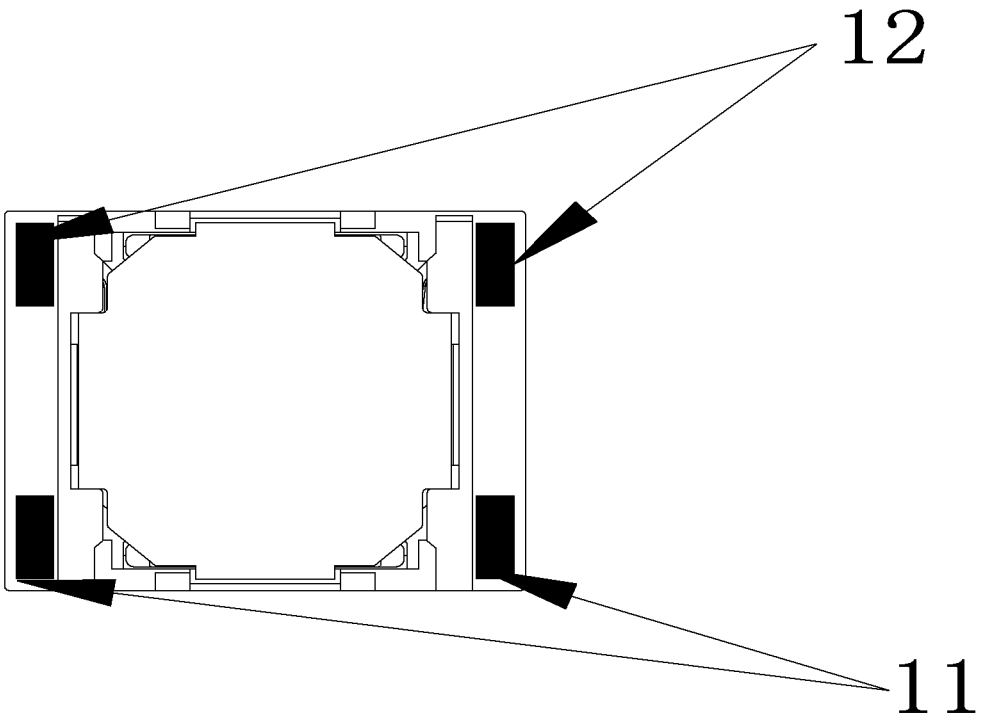
FIG. 4 is a back view of an electrical-acoustic transformation device according to an embodiment of the present invention.

The housing is injection-molded with an electrical connection portion. As shown in FIGS. 3 and 4, the electrical connection portion may be led out from the back surface (that is, the surface closer to the magnetic circuit system) of the electrical-acoustic transformation device to be connected to an external circuit. Two first electrical connection portions 11 are used to connect the first conductive line 100 and the external circuit to access a first audio signal. Two second electrical connection portions 12 are used to connect the second conductive line and the external circuit to access a second audio signal. The electrical connection portion includes any one of or a combination of the following: an elastic sheet, a spring connector (Pogopin), a spring and a flexible circuit board.

The electrical-acoustic transformation device in an embodiment of the present invention has a moving coil sound generating structure and a piezoelectric sound generating structure. The piezoelectric plate compensates the high-frequency response of the vibration system, realizing an electrical-acoustic transformation device with good performance and super wideband. Preferably or alternatively, in an embodiment of the present invention, a first conductive line is formed on the diaphragm to input an externally input first audio signal into the piezoelectric plate, thus the wiring is delicate and easy to realize. Preferably or alternatively, the piezoelectric plate in an embodiment of the present invention is provided at the center of the diaphragm which can function as diaphragm reinforcement.

Although some specific embodiments of the present invention have been described in detail by way of example, it should be understood by those skilled in the art that the above examples are merely for the sake of description rather than limiting the scope of the present invention. It should be understood by those skilled that the above embodiments may be modified without departing from the scope and spirit of the present invention. The scope of the present invention is limited by the appended claims.

What is claimed is:

1. An electrical-acoustic transformation device, comprising:

a vibration system and a magnetic circuit system with a magnetic gap;

wherein the vibration system includes: a diaphragm, a voice coil provided below the diaphragm and suspending in the magnetic gap, and a piezoelectric plate provided on one side of the diaphragm;

conductive lines are formed on the diaphragm, and the conductive lines include a first conductive line connected to the piezoelectric plate to input an externally input first audio signal to the piezoelectric plate via the first conductive line;

the conductive lines also include a second conductive line connected to the voice coil to access an externally input second audio signal to the voice coil via the second conductive line; and the second conductive line is formed on a lower surface of the diaphragm.

2. The device according to claim 1, wherein the piezoelectric plate is provided above or below the diaphragm.

3. The device according to claim 1, wherein the piezoelectric plate is provided above the diaphragm and the first conductive line is formed on an upper surface of the diaphragm.

4. The device according to claim 1, wherein the piezoelectric plate is provided at the center location of the diaphragm.

5. An electrical-acoustic transformation device, comprising:

a vibration system and a magnetic circuit system with a magnetic gap;

wherein the vibration system includes: a diaphragm, a voice coil provided below the diaphragm and suspending in the magnetic gap, and a piezoelectric plate provided on one side of the diaphragm;

conductive lines are formed on the diaphragm, and the conductive lines include a first conductive line connected to the piezoelectric plate to input an externally input first audio signal to the piezoelectric plate via the first conductive line; and wherein the diaphragm includes a planar portion located at the center and a surround portion located at an edge of the planar portion, and the piezoelectric plate is provided at the location of the planar portion of the diaphragm.

6. The device according to claim 1, wherein the conductive lines are electroplated on the diaphragm or the conductive lines are formed by the etching of a flexible circuit board laminated on the diaphragm.

7. An electrical-acoustic transformation device, comprising:

a vibration system and a magnetic circuit system with a magnetic gap;

wherein the vibration system includes: a diaphragm, a voice coil provided below the diaphragm and suspending in the magnetic gap, and a piezoelectric plate provided on one side of the diaphragm;

conductive lines are formed on the diaphragm, and the conductive lines include a first conductive line connected to the piezoelectric plate to input an externally input first audio signal to the piezoelectric plate via the first conductive line; and a housing for accommodating and fixing the vibration system and the magnetic circuit system, wherein the housing is injection-molded with electrical connection portions through which the conductive lines are connected to external circuits.

8. The device according to claim 7, wherein the electrical connection portion includes any one of or a combination of the following: an elastic sheet, a spring connector and a flexible circuit board.

* * * * *